US005804134A

United States Patent [19]

Tomat et al.

[11] Patent Number: 5,804,134

[45] Date of Patent: Sep. 8, 1998

[54] COMPACT ROLLING BLOCK

[75] Inventors: Ferruccio Tomat; Attilio Sacchi; Gianni Nonino, all of Udine; Giorgio Lavaroni, Buttrio, all of Italy

[73] Assignee: Daniele & C. Officine Meccaniche SpA, Buttrio, Italy

[21] Appl. No.: 762,937

[22] Filed: Dec. 10, 1996

[30] Foreign Application Priority Data

Dec. 22, 1995 [IT] Italy ..... UD95A0250

[51] Int. Cl.[6] ..... B21B 31/07

[52] U.S. Cl. ..... 266/102; 72/239

[58] Field of Search ..... 266/102, 103; 72/234, 235, 239, 238, 227

[56] References Cited

U.S. PATENT DOCUMENTS 5,095,728 3/1992 Poloni ..... 72/239

FOREIGN PATENT DOCUMENTS 2490117 3/1982 France .
3819588 1/1989 Germany .
57-121814 7/1982 Japan .
58-16709 1/1983 Japan .
58-218315 12/1983 Japan .
61-27106 2/1986 Japan .
2063742 6/1981 United Kingdom .

*Primary Examiner*—Scott Kastler
*Attorney, Agent, or Firm*—Stevens, Davis, Miller & Mosher, L.L.P.

[57] ABSTRACT

Compact rolling block comprising at least one rolling mill stand having a horizontal axis and at least one rolling mill stand having a vertical axis, two end rolling mill stands having the same axis and being separated by a central rolling mill stand having an axis substantially at 90° to the axes of the two end rolling mill stands, the end rolling mill stands (11, 13) being positioned beside each other and close together, each being associated with its own container (42) which surrounds them at least partly, at least one container (42) being movable, there also being included at least one upstream containing housing (30*a*), and a downstream containing housing (30*b*), at least one containing housing (30) being movable.

20 Claims, 4 Drawing Sheets

COMPACT ROLLING BLOCK

FIELD OF THE INVENTION

This invention concerns a compact rolling block.

The invention is applied to the field of iron and steel production plants and, to be more exact, to the field of rolling carried out with rolling mill stands having rolling rolls.

BACKGROUND OF THE INVENTION

Rolling lines of the field of rolling include a plurality of rolling mill stands positioned in series in which the rolled stock is reduced progressively to the desired dimension with very close tolerances for the diameter and oval form of the finished product.

The state of the art includes rolling blocks which comprise a plurality of rolling mill stands with rolling rolls, the stands being positioned side by side and separated.

In the plants of the state of the art each rolling mill stand comprises its own motor and its own gear casing with resulting high costs and great overall volumes.

In fact, the inclusion of the motors and of the gear casings has the effect that the distance between adjacent rolling mill stands is great with a resulting need to use guides to guide the rolled stock at an intermediate position between the rolling mill stands.

Furthermore, as the rolling mill stands are alternately of a type with a vertical axis and of a type with a horizontal axis, the rolled stock tends to rotate along its axis between one stand and the next, thus entailing finished products of a poor quality as regards the circular nature of their cross section.

The teachings of JP-A-58-16709 are known.

In this prior document the rolling block comprises two end rolling mill stands with a vertical axis and a central rolling mill stand with a horizontal axis.

This prior document teaches to include on a fixed base some boxes within which the rolling mill stands are inserted and clamped in order to create a single unit with the boxes and the base.

This prior document teaches to create a single unit which causes problems of overall bulk, problems of partial maintenance, problems of obstructions and re-setting, problems of control and government.

SUMMARY OF THE INVENTION

The present applicants have designed, tested and embodied this invention to overcome the shortcomings of the state of the art and to achieve further advantages.

The purpose of this invention is to provide a compact rolling block with rolling mill stands including rolling rolls, the block reducing considerably the dimensions of the rolling line and enabling the operations for replacement and/or maintenance to be carried out quickly and simply.

The invention also has the purpose of simplifying the government and control of the rolling mill stand.

Moreover, the invention has the further purpose of reducing the vibrations and noise and also of guiding the rolled stock better and of preventing rotation of the rolled stock between one rolling mill stand and the next one, especially in the case of products involving small percentages of reduction of cross-section, thus ensuring finished rolled products remaining within even smaller tolerances.

The invention is applied advantageously to compact rolling blocks having the functions of gauging means.

The compact rolling block according to the invention comprises at least one rolling mill stand having a horizontal axis and at least one rolling mill stand having a vertical axis, two end rolling mill stands with the same axis being separated by a central rolling mill stand having its axis substantially at 90° to the axes of the two end rolling mill stands.

The two end rolling mill stands are associated with a first gear casing forming a base for a second gear casing associated with the central rolling mill stand.

According to a first embodiment of the invention the compact rolling block comprises two end rolling mill stands having a horizontal axis and one central rolling mill stand having a vertical axis.

According to a variant the compact rolling block comprises two end rolling mill stands having a vertical axis and one central rolling mill stand having a horizontal axis.

Hereinafter we shall deal with the horizontal/vertical/horizontal variant, but shall be understood to comprise also the second vertical/horizontal/vertical variant.

According to the invention the bodies of the rolling mill stands are in close contact with each other and form a structural continuity which reduces the vibrations and makes the structure more solid and more stable inasmuch as the rolling mill stands are positioned side by side and close to each other and are associated with at least one containing housing.

According to a variant an upstream containing housing and a downstream containing housing are included.

According to a particular embodiment of the invention at least one containing housing can be moved along the rolling axis.

According to a variant the Containing housing can be moved in a direction perpendicular or substantially perpendicular to the rolling axis.

In a particular embodiment of the invention each rolling mill stand cooperates with its own container, the containers being side by side in the working position and at least the two end containers being movable.

The rolling mill stand is inserted into the container so that it can be replaced independently of the other stands with simple and quick operations.

The containing housings have the task of eliminating the drawing/thrust which acts on the rolling mill stands of the compact block.

The containing housings, where they are movable, are associated with actuation and positioning means.

These actuation and positioning means enable the containing housings to be distanced from each other so as to release the containers as a whole and to release the containers from each other, thus making possible an easy replacement of the containers as a whole and of the single containers.

In this way, it is possible with a quick and simple operation to have access to the guide boxes of the rolled stock and to adjust the rolling boxes and/or to check any wear on those boxes and also to replace a single rolling mill stand.

Moreover, this situation enables any obstructions which may take place in the compact rolling block to be freed very quickly.

According to the invention the rolling mill stands forming the compact rolling block can be replaced individually with or without their respective container.

The rolling mill stands can also be replaced as a group together with their respective containers.

The replacement can be carried out also with other rolling mill stands possibly having rolling rolls of different dimensions and possibly having different distances between centers of the rolling mill stands so as to produce rolled products of various dimensions.

The replacement can take place with a crane or with a transfer and positioning trolley.

Depending on the size of the rolling rolls and for the purpose of obtaining better qualities of the rolled stock as regards tolerances and circular condition, the rolling mill stands associated with the compact rolling block according to the invention have different distances between centers.

According to a first variant at least the containing housing at the outlet of the compact rolling block includes an appropriate recess in which is located a monitor to measure the diameter of the rolled stock so as to check the exact value of that diameter.

According to another variant the containing housing at the inlet too of the compact rolling block includes an appropriate recess in which is located a monitor to measure the diameter of the rolled stock.

These monitors to measure the diameter of the rolled stock can be of a stationary type or of a rotary type.

According to a particular form of embodiment these monitors to measure the diameter of the rolled stock are incorporated in the relative containing housing.

According to a further variant the compact rolling block according to the invention is governed by a control and governing unit which, on the basis of the data monitored by the monitor of the diameter or by the monitors of the diameter, performs a control with a closed ring and carries out automatically the adjustment of the gap and the axial adjustment of the compact rolling block.

According to yet another variant at least the upstream containing housing includes a monitor to check the temperature of the rolled stock.

The three rolling mill stands are connected to their respective gear casings by means of movable extensions, which can be connected up axially and are advantageously supported by movable supports.

The movement of these supports enables the extensions to be quickly and simply released, thus making possible an easy corrective action.

The rolling mill stands are driven by independent motors connected to each other mechanically or electrically so as to ensure a correct difference of peripheral speed according to the type of rolled product.

According to one embodiment of the invention the rolling mill stands are of a cartridge type.

According to another embodiment of the invention the rolling mill stands are of a type with rolling rolls.

Where the rolling mill stands are of a type with rolling rolls, the chocks of the rolls are associated with the relative opposed sidewalls of the container so as to be able to oscillate on a horizontal axis of oscillation perpendicular to the axis of the rolling roll and central to the chock and lying on the respective plane containing the axis of the roll, this plane being parallel to the other plane containing the axis of the other roll.

In this way, the longitudinal bending of the rolling rolls caused by the rolling force acting on those rolls causes an oscillation of the respective two chocks associated with the single roll in opposite directions.

This system of fixture of the chock to the container enables the chock to withstand both the axial thrust and the radial thrust and prevents the occurrence of additional loads on the bearings associated with the rolling roll and with the relative chock.

To be more exact, the chocks include guide and positioning means comprising oscillation means formed with a pivot or an articulated joint and cooperating with cradle means of a mating shape associated with the opposite sidewalls of the container.

These oscillation means may be of a type protruding from the chock or of a type included within the overall volume of the chock with a resulting reduction of the overall bulk.

These oscillation means may be associated with the narrow lateral surfaces or with the wide lateral surfaces of the chocks.

The cradle means with which the oscillation means cooperate are associated with suitable adjustment means to enable them to be reciprocally positioned and distanced according to the operations of insertion/withdrawal of the rolling mill stand into/from the relative container.

Where the assembly of the three rolling mill stands is installed on a transfer and positioning trolley, the latter cooperates with frontally positioned transfer guides including at least a second auxiliary transfer and positioning trolley bearing a further assembly of three rolling mill stands ready for use.

In this way it is possible to carry out a complete and quick replacement of the compact rolling block so as to enable maintenance work to be carried out in the workshop with greater accuracy and with all the equipment available and therefore with shorter replacement times, thus reducing to a minimum the downtimes of the rolling plant.

BRIEF DESCRIPTION OF THE DRAWING

The attached figures are given as a non-restrictive example and show some preferred embodiments of the invention as follows.

DETAILED DESCRIPTION OF THE PREFERRED EMBODIMENTS

Figure 1:
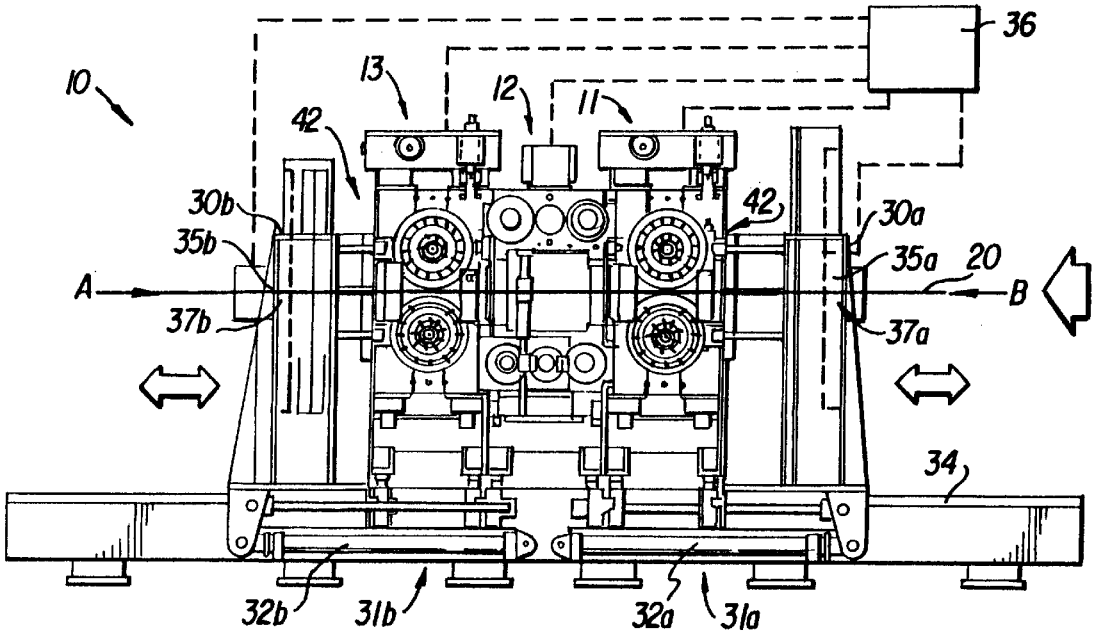
FIG. 1 is a side view of a compact rolling block according to the invention in the closed working position.

The reference number 10 in the figures denotes generally a compact rolling block according to the invention.

In this case the compact rolling block 10 according to the invention comprises two end rolling mill stands 11, 13 with a horizontal axis and one central rolling mill stand 12 with a vertical axis, the stands being associated with each other.

In the following description the words "horizontal" and "vertical" refer to the axes of the rolling rolls.

According to a variant which is not shown here, the compact rolling block 10 comprises two end rolling mill stands with a vertical axis and one central rolling mill stand with a horizontal axis.

The three rolling mill stands 11, 12, 13 are in contact with each other and may even be contained in one single structure.

The compact rolling block 10 includes a first gear casing 16 with which are associated motors 17*a*, 17*c* of the horizontal rolling mill stands 11, 13.

This first gear casing 16 forms a support for a motor 17*b* and a second gear casing 25 associated with the central vertical rolling mill stand 12, thereby enabling the overall bulk of the compact rolling block 10 according to the invention to be reduced.

Mechanical connection between the three motors 17 may take place by means of a reduction gear system which can be connected up/disconnected in desired conditions of ratio by means of a control lever operated by the machine operator.

In the compact rolling block 10 according to the invention the rolls 40 of the end rolling mill stands 11, 13 and of the central rolling mill stand 12 are connected to respective gear casings 16, 25 by means of respective extensions 18*a*, 18*c* and 18*b*.

The extensions 18*a*, 18*b*, 18*c* include respective terminal connecting bushes 28*a*, 28*b*, 28*c*.

The connecting bushes 28*a*, 28*b*, 28*c* are supported by support means 27, 127, which can be positioned by actuation units 29, 129 so as to connect/disconnect the respective connecting bushes 28*a*, 28*b*, 28*c* to/from the ends of the rolls 40.

In the compact rolling block 10 according to the invention the connecting and disconnecting of the rolls 40 to/from the respective extensions 18*a*, 18*b*, 18*c* are therefore carried out simply and quickly by operating the actuation units 29, 129, thus simplifying considerably the operations of maintenance and replacement.

In this case, the three rolling mill stands 11, 12, 13 forming the compact rolling block 10 are stands with rolls 40 of a cartridge-type, each rolling mill stand 11, 12, 13 being fitted to its own container 42.

The containers 42 are positioned in contact with each other, there being included at each end a respective upstream containing housing 30*a* and a respective downstream containing housing 30*b*.

Figure 2:
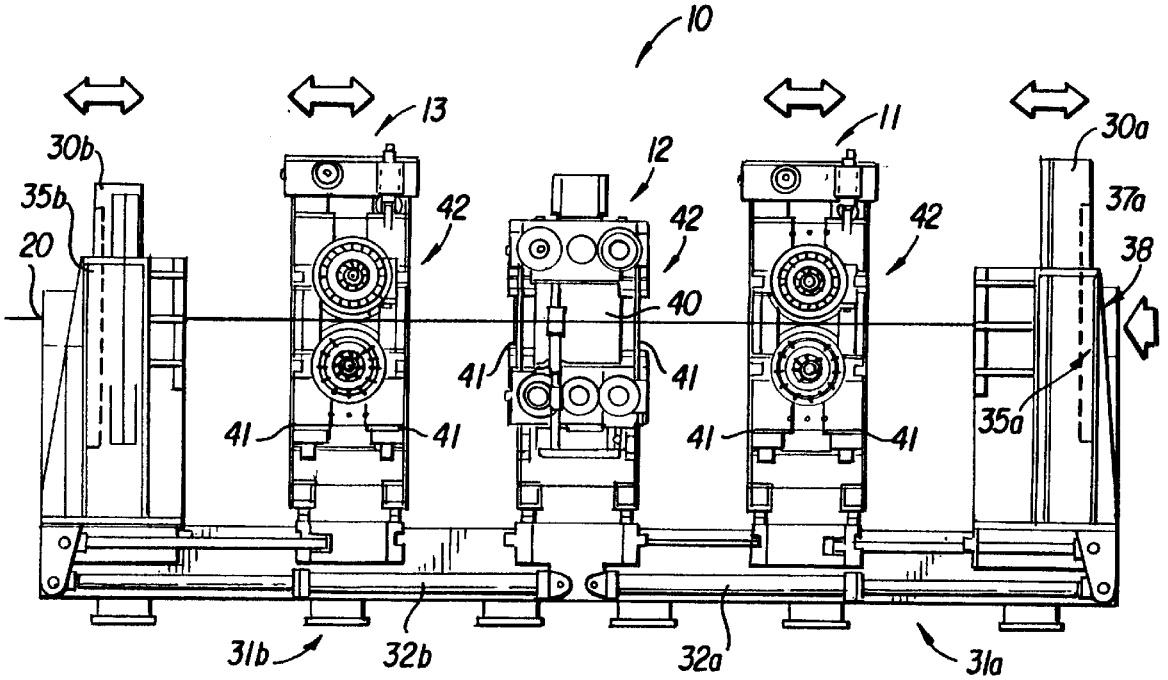
FIG. 2 shows the compact rolling block of FIG. 1 in an open inactive position.
Figure 5:
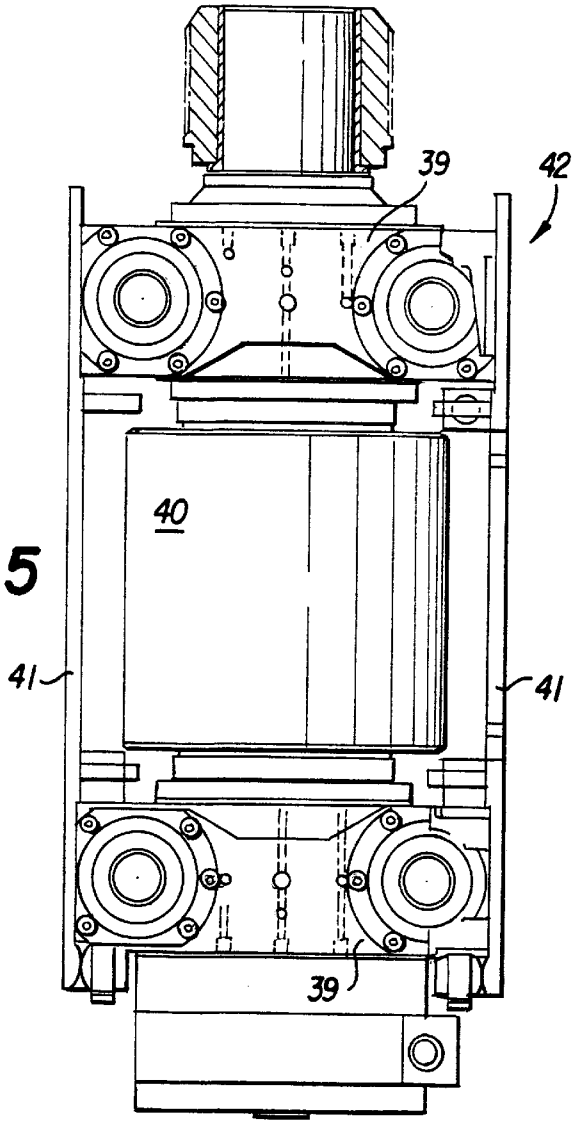
FIG. 5 is a diagrammatic side view of the vertical cartridge-type rolling mill stand of the compact rolling block of FIG. 1.
Figure 3B:
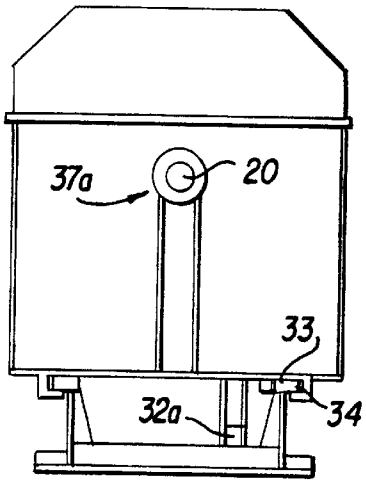
FIGS. 3*a* and 3*b* show front views of the compact rolling block of FIG. 1 according to the arrows A and B respectively.

The containing housings 30*a*, 30*b* can be moved along the rolling axis 20 so as to be released from the containers 42 as shown in FIG. 2.

In this case the containing housings 30*a*, 30*b* can be moved along the rolling axis 20.

According to a variant the containing housings 30*a*, 30*b* can be moved in a direction perpendicular or substantially perpendicular to the rolling axis 20.

In this example the containers 42 too associated with the horizontal rolling mill stands 11 and 13 can be moved independently along the rolling axis 20, thus enabling corrective action and/or replacement to be carried out on the cartridge rolling mill stands 11, 12, 13 individually.

According to a variant which is not shown here the rolling mill stands 11, 12, 13 are associated with one single container 42.

The three rolling mill stands 11, 12, 13, whether they are associated with their own respective containers 42 or with one single container 42, can be replaced individually or en bloc.

In this way, the same one compact rolling block 10 can be used also to produce rolled products having different dimensions.

The movement of the containing housings 30*a*, 30*b* also makes possible the installation of containers 42 in which the distance between centers of the rolling mill stands 11, 12, 13 varies.

In this case, the containing housings 30*a*, 30*b* and the containers 42 associated with the horizontal rolling mill stands 11, 13 are associated with transfer and positioning means 31 comprising actuators 32*a*, 32*b*.

In this case, the containers 42 associated with the end rolling mill stands 11, 13 and the containing housings 30*a*, 30*b* can be moved on slides 33 cooperating with rails 34 associated with the base of the compact rolling block 10.

According to a variant at least the downstream containing housing 30*b* includes a recess 37*b* in which is located a monitor 35*b* which measures the diameter of the rolled stock passing through.

In this case, the upstream containing housing 30*a* too includes a recess 37*a* in which is located a monitor 35*a* which measures the diameter of the rolled stock passing through.

According to a variant these monitors 35*a*, 35*b* measuring the diameter of the rolled stock are incorporated in the respective containing housing 30*a*, 30*b*.

These monitors 35*a*, 35*b* measuring the diameter of the rolled stock may be of a stationary type or of a rotary type.

These monitors 35*a*, 35*b* measuring the diameter of the rolled stock are associated, in this example, with a control and governing unit 36, which on the basis of the signals coming from the monitors 35*a*, 35*b* of the diameter of the rolled stock act automatically on the means adjusting the gap and on the means performing axial adjustment of the compact rolling block 10 so as to ensure a better control of the rolled product.

According to another variant at least the upstream containing housing 30*a* incorporates at least one monitor 38, of a pyrometer type for instance, to check the temperature of the rolled stock.

FIGS. 6 to 9 show diagrams of some possible forms of embodiment of the system to secure the chock 39 to the sidewalls 41 of the relative container 42 where the rolling mill stands include rolls.

This securing system enables the chock 39 to oscillate on an axis of oscillation 14 perpendicular to the axis of the rolling roll 40 with which that chock 39 is associated.

Figure 6:
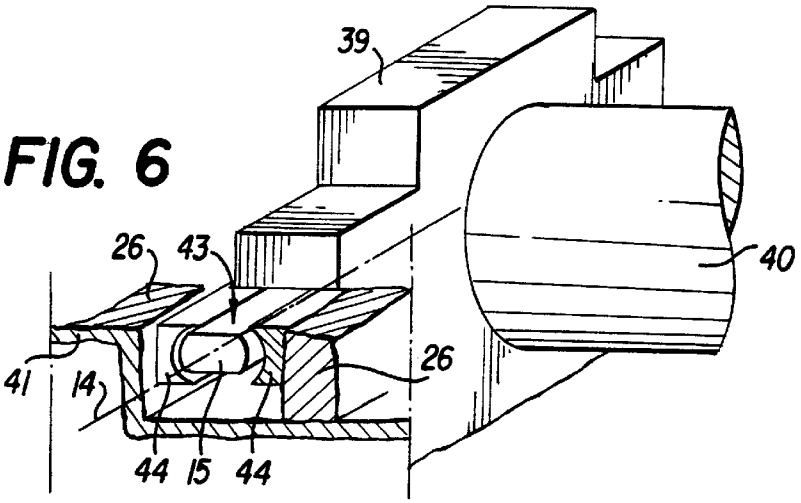
FIG. 6 is a partial three-dimensional view of the system of fixture of the chock to the container associated with the rolling mill stand of FIG. 5.
Figure 3A:
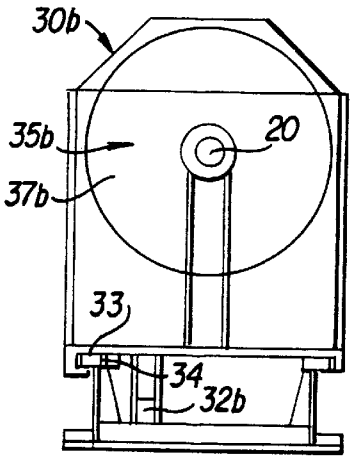
Figure 7:
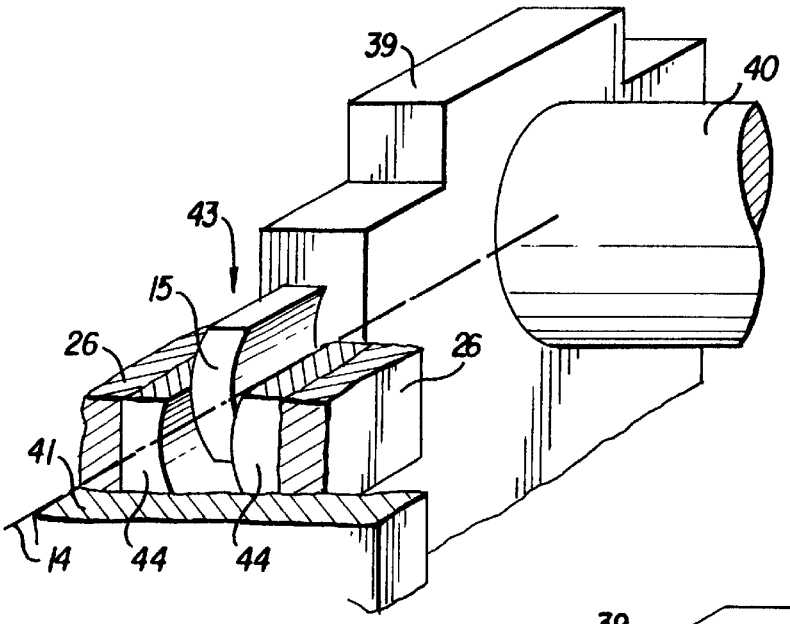
FIGS. 7, 8 and 9 show three possible variants of the system of fixture of the chock of FIG. 6.
Figure 8:
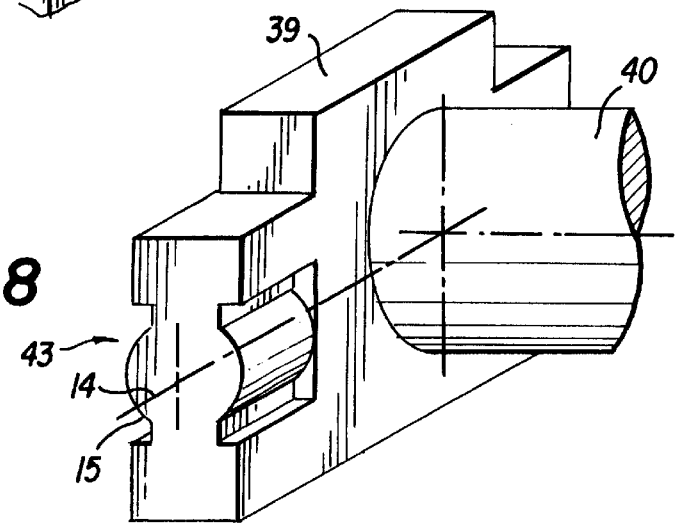

In the forms of embodiment shown in FIGS. 6 and 7 the chock 39 includes guide and positioning means comprising oscillation means 43, which consist of oscillation pivot means 15 protruding from the narrow lateral surface of the chock 39 and lying on the horizontal plane which contains the axis of the relative rolling roll 40.

In the form of embodiment shown in FIG. 7 the oscillation means 43 are included directly in the wide lateral surface of the chock 39.

During installation the oscillation means 43 cooperate with cradle means 44 having a form mating with the oscillation means 43 and associated with the sidewall 41 of the container 42.

In this example, the cradle means 44 are removably associated with supporting and positioning elements 26 cooperating with the relative sidewall 41 of the container 42.

This embodiment makes possible a ready replacement of the cradle means 44 in the event of wear and/or deformation.

According to a variant the cradle means 44 may form one single body together with the relative sidewall 41 of the container 42.

Figure 9:
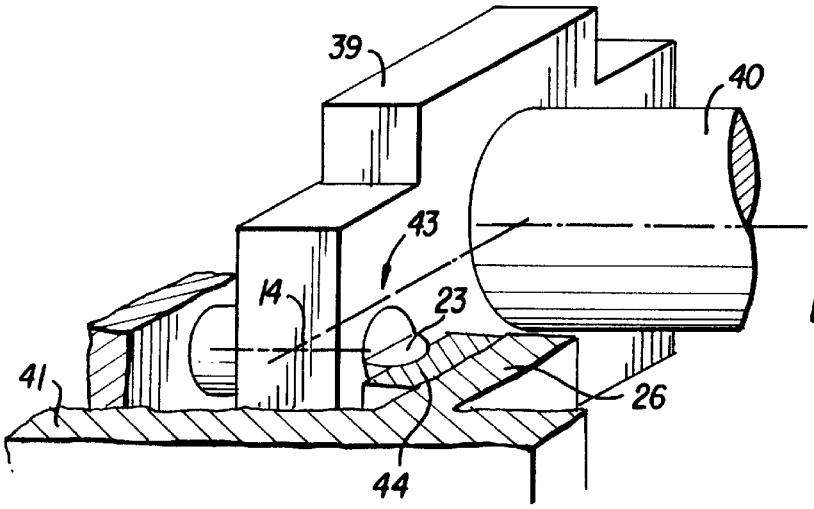

In the form of embodiment shown in FIG. 9 the oscillation means 43 consists of a ball-joint 23 associated with the wide sidewall of the chock 39 and cooperating with cradle means 44 of a mating shape.

These cradle means 44 cooperate advantageously with adjustment means which make possible a reciprocal distancing/approach of the cradle means 44 so as to enable the operations of insertion and removal of the rolling mill stands 11, 12, 13 into/from their respective containers 42 to be carried out.

According to another variant which is not shown here, the oscillation means 43 are associated with the sidewall 41 of the container 42, while the cradle means 44 are associated with the chock 39.

Figure 4:
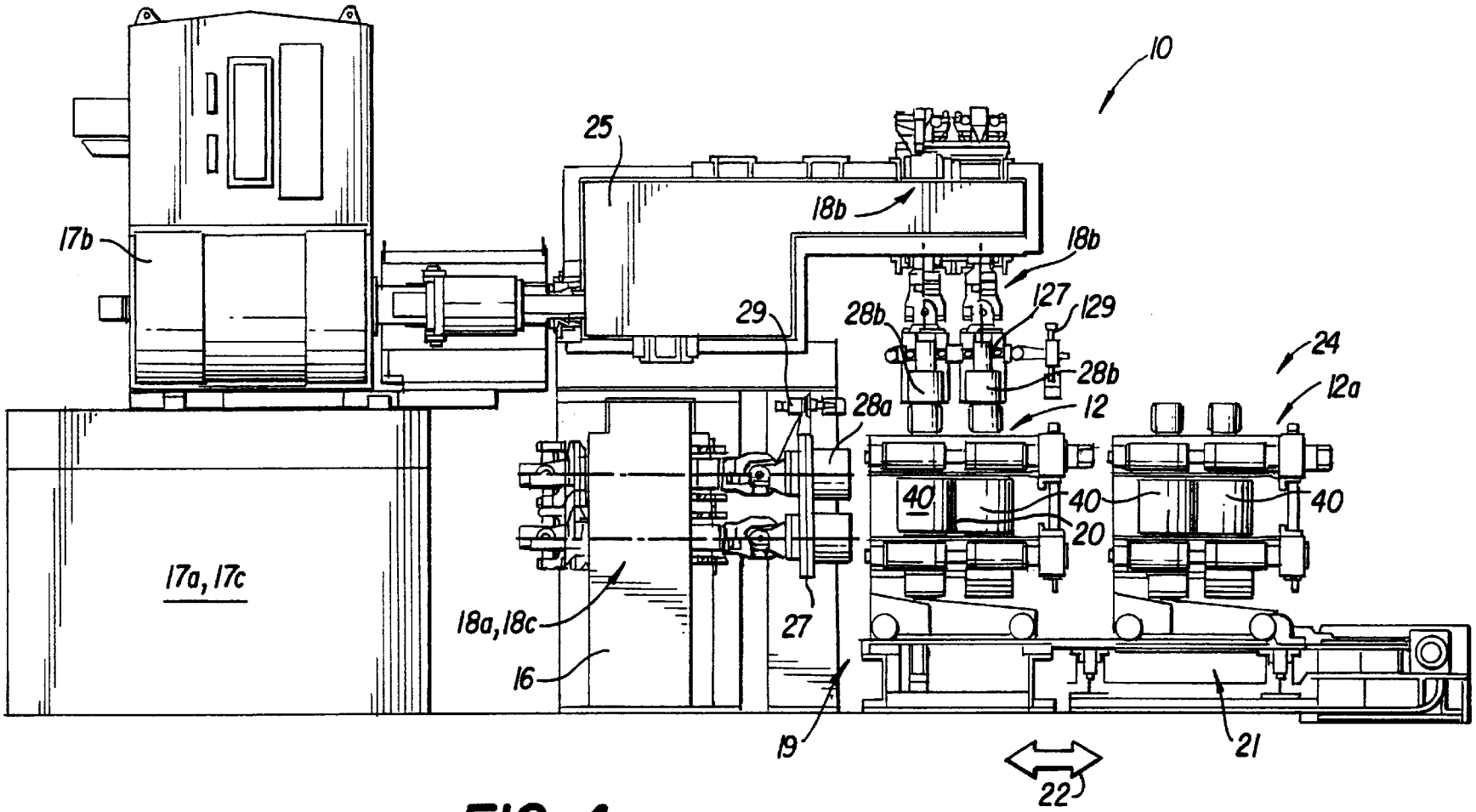
FIG. 4 is a side view of the compact rolling block of FIG. 1 in association with transfer guides.

In the form of embodiment shown in FIG.4 the three rolling mill stands 11, 12, 13 are fitted to one single trolley 19 able to move according to the arrows 22 at a right angle to the rolling axis 20 so that the trolley 19 can be distanced when the rolls 40 have been disconnected from their respective extensions 18 associated with their respective gear casing 16, 25.

This transfer and positioning trolley 19 includes means for its clamping to the base, these means not being shown here but being capable of being momentarily actuated to ensure a safe and accurate fixture when the trolley 19 is cooperating with the compact rolling block 10 according to the invention.

This transfer and positioning trolley 19 cooperates with transfer guides 21, on which is installed a second auxiliary trolley 24, which can be moved and which bears three other rolling mill stands 11*a*, 12*a*, 13*a* ready for use.

In this way, in the event of maintenance or of an obstruction or an accident, it is possible to replace the three rolling mill stands 11, 12, 13 with the three spare rolling mill stands 11*a*, 12*a*, 13*a* by replacing the transfer and positioning trolley 19 with the second auxiliary transfer and positioning trolley 24.

This reduces the downtimes of the rolling line and enables the operations of maintenance of the rolling mill stands 11, 12, 13 to be carried out in the workshop.

We claim:

1. A compact rolling block (10) comprising a first and a second rolling mill stands (11, 13) having rolls with the rotational axes parallel therebetween and a third rolling mill stand (12) disposed between said first and second rolling mill stands (11, 13) and having rolling rolls with the rotational axes parallel therebetween and substantially at 90° with respect to the axes of the rolls of said first and second rolling mill stands (11, 13), wherein each rolling mill stand (11, 12, 13) is mounted into a corresponding container (42), wherein at least one of said container (42) is movable laterally with respect to the other containers, wherein two containing housing (30*a*, 30*b*) are provided externally to said rolling mill stands (11, 12, 13), and wherein means (31*a*, 31*b*) are provided for laterally moving at least one of said containing housing with respect to the other of said containing housing.

2. A compact rolling block (10) as in claim 1, in which the containing housing (30*a*, 30*b*) is movable along a rolling axis (20) of said rolling block.

3. A compact rolling block (10) as in claim 1, in which at least one containing housing (30*a*, 30*b*) cooperates with rails (34) for movement which are substantially parallel to the rolling axis (20).

4. A compact rolling block (10) as in claim 1, in which at least one end container (42) cooperates with rails (34) for movement which are substantially parallel to a rolling axis (20) of said rolling block.

5. A compact rolling block (10) as in claim 1, in which at least one containing housing (30*a*, 30*b*) comprises in cooperation with a rolling axis (20) of said rolling block a recess (37) to lodge and position measuring monitor means (35*a*, 35*b*).

6. A compact rolling block (10) as in claim 1, in which the rolling mill stands (11, 12, 13) have rolling rolls/rings (40) of different dimensions.

7. A compact rolling block (10) as in any claim 1, in which the rolling mill stands (11, 12, 13) have different distances between centers.

8. A compact rolling block (10) as in claim 1, further comprising chocks in which each chock (39) cooperates with an opposed sidewall (41) of the container (42) by means of guide and positioning means.

9. A compact rolling block (10) as in claim 9, in which the guide and positioning means comprise oscillation means (43) associated with cradel means (44), the oscillation means (43) being defined by an oscillation axis (14) perpendicular to the axis of the respective rolling roll (40) and substantially central to the chock (39).

10. A compact rolling block (10) as in claim 9, in which the oscillation means (43) are associated with the sidewall (41) of the container (42).

11. A compact rolling block (10) as in claim 9, in which the oscillation means (43) are associated with the chock (39).

12. A compact rolling block (10) as in any claim 1, which incorporates at least one means (38) to measure the temperature of the rolled stock.

13. A compact rolling block (10) as in any claim 1, which is governed by a control and governing unit (36) associated at least with a monitor (35*a*, 35*b*) that measures the diameter of the rolled stock.

14. A compact rolling block (10) as in claim 1, which is governed by a control and governing unit (36) associated at least with a means (38) that measures temperature of stock fed to the block.

15. A compact rolling block (10) as in claim 2, in which one of said containers is an upstream container and the upstream container (42) is movable along the rolling axis (20).

16. A compact rolling block (10) as in claim 2, in which at least one containing housing (30*a*, 30*b*) cooperates with rails (34) for movement which are substantially parallel to the rolling axis (20).

17. A compact rolling block (10) as in claim 1, in which at least one containing housing (30*a*, 30*b*) cooperates with rails (34) for movement which are substantially parallel to the rolling axis (20).

18. A compact rolling block (10) as in claim 2, in which at least one end container (42) cooperates with rails (34) for movement which are substantially parallel to the rolling axis (20).

19. A compact rolling block (10) as in claim 1, in which at least one end container (42) cooperates with rails (34) for movement which are substantially parallel to the rolling axis (20).

20. A compact rolling block (10) as in claim 1, in which one of said containers is an upstream container and the upstream container (42) is movable along a rolling axis (20) of said rolling block.

* * * * *

UNITED STATES PATENT AND TRADEMARK OFFICE

CERTIFICATE OF CORRECTION

PATENT NO. : 5,804,134

DATED : September 8, 1998

INVENTOR(S) : TOMAT et al

It is certified that error appears in the above-identified patent and that said Letters Patent is hereby corrected as shown below:

ON THE TITLE PAGE:

Item

[73], change "Daniele & C. Officine Meccaniche" to --Danieli & C. Officine Meccaniche--.

Signed and Sealed this

Thirteenth Day of June, 2000

*Attest:*

Q. TODD DICKINSON

*Attesting Officer*

*Director of Patents and Trademarks*